US009150293B1

(12) United States Patent
Swerdlin

(10) Patent No.: US 9,150,293 B1
(45) Date of Patent: Oct. 6, 2015

(54) OCEAN SURVIVAL SYSTEM

(71) Applicant: Lee Swerdlin, Miami, FL (US)

(72) Inventor: Lee Swerdlin, Miami, FL (US)

( * ) Notice: Subject to any disclaimer, the term of this patent is extended or adjusted under 35 U.S.C. 154(b) by 0 days.

(21) Appl. No.: 14/260,254

(22) Filed: Apr. 23, 2014

Related U.S. Application Data

(63) Continuation-in-part of application No. 13/369,256, filed on Feb. 8, 2012, now abandoned.

(60) Provisional application No. 61/463,767, filed on Feb. 23, 2011.

(51) Int. Cl.
*B63C 9/03* (2006.01)
*B63C 9/05* (2006.01)

(52) U.S. Cl.
CPC ..... *B63C 9/05* (2013.01)

(58) Field of Classification Search
CPC ..... B63C 9/05
See application file for complete search history.

(56) References Cited

U.S. PATENT DOCUMENTS 1,129,108 A * 2/1915 McKelvy ..... 441/87
2006/0024344 A1* 2/2006 Matos et al. ..... 424/405

OTHER PUBLICATIONS http://www.spearfishingworld.com/real-sea-camo-3mm.html Aug. 2003.*

* cited by examiner

*Primary Examiner* — Edwin Swinehart
(74) *Attorney, Agent, or Firm* — Christian Sanchelima

(57) ABSTRACT

The invention is an amorphous bag designed and shaped, that when deployed, slipped around the body up to the neck and secured to a flotation means, so when floating in the ocean, provides a user deterrent protection from shark attack. It is sized to enclose a person, made of a flexible, impermeable, multi-colored, metallic polyester, and/or any material that can be formed into a thin film of a durable thickness; with the top end open, and bottom end sealed closed. The exterior has various camouflaging color patterns to disguise the device by blending in with the surrounding ocean to reduce the risk of shark attack. The interior is a reflective silver color for signaling to rescue craft. The amorphous bag further includes two flaps made of the excess material from the amorphous bag extending from front and rear sides of top open end. The seal created using excess material flaps substantially envelope a user to prevent leaking of body fluids that can escape and attract sharks. The cover provided by excess material flaps creates a thermal chamber which slows the onset of hypothermia or sun damage, thus increasing survival duration.

3 Claims, 7 Drawing Sheets

OCEAN SURVIVAL SYSTEM

OTHER RELATED APPLICATIONS

The present application is a continuation-in-part of U.S. patent application Ser. No. 13/369,256, filed on Feb. 8, 2012, which claims the benefit of provisional application No. 61/463,767 filed on Feb. 23, 2011. Both applications are hereby incorporated by reference.

BACKGROUND OF THE INVENTION

1. Field of the Invention

The present invention pertains to protecting a person from potential shark attack and more particularly to such systems that camouflages the user, and additional aids in a ocean survival situation.

2. Description of the Related Art

Applicant believes that the closest reference corresponds to U.S. Pat. No. 3,986,220 issued to Johnson and U.S. Pat. No. 3,222,701 issued to Fest. In the past several present inventions for deterring shark attacks have been developed. Some of these present inventions attempt to obscure the human body or somehow make its shape unattractive to sharks. At present all methods of shark deterrents have major flaws; they are either temporary, drift away, run out, fail to function, cannot be sustained, or are not small enough to be easily carried for emergency use. Scientific research and actual observation has shown that sharks are attracted to blood, motion, or silhouettes that look like their natural food prey. These factors are natural prey triggers and can prompt a shark attack. A person floating in the ocean, producing these triggers, is especially vulnerable to shark attack necessitating the development of a present invention to offer protection from such attacks. A black colored bag-shaped present invention has been found to provide a degree of protection from detection and attack, and at least two versions have been patented.

U.S. Pat. No. 3,222,701 to Andre Fest disclosed a tubular sheath attached to and supported by a cork ring to keep a person afloat and shield them from shark attack. However, the open bottom allowed blood and other body fluids to escape from the present invention, still attracting sharks. Additionally, the size, shape, and bulk of the present invention made it impractical to be carried by an individual for use in an emergency.

U.S. Pat. No. 3,428,978 to C. S. Johnson disclosed a black elongated bag with multiple inflatable compartments for flotation and a closing hood. However, the present invention could not be reduced to a small enough size to be carried by an individual, and the enclosing apron design is susceptible, in rough seas, to cause the present invention to fill with water, potentially drowning the user while inside. Additionally, as relates to both, subsequent research has shown that sharks now associate floating black bags with food and have begun predation on black bags. Therefore, due to the design flaws in these two patents and all of the various types of shark attack deterrent present inventions, there continues to be a need for a shark attack deterrent present invention that conceals and disguises a person, prevents the escape of body fluids that attract sharks, eliminates susceptibility to drowning when used, and is small enough to be carried on a person to be readily available for use when needed in an ocean survival situation.

Other documents describing the closest subject matter provide for a number of more or less complicated features that fail to solve the problem in an efficient and economical way. None of these patents suggest the novel features of the present invention.

SUMMARY OF THE INVENTION

It is the objective of the present invention to provide a system were the user is camouflaged to deter shack attack, and their body is insulated from the surrounding body of water thermally and physically, and can be used to signal rescue craft.

The present invention has several advantages over the prior art, one of the advantages is that it's made with various camouflaging color patterns on the exterior to disguise the embodiment from detection and attack from sharks by blending in with the surrounding ocean. The second advantage is the method of securing the embodiment to a floatation means presently illustrated as a life vest to prevent the user from drowning, and reduces the size and weight so the embodiment is of a small enough size to be carried on a person so as to be readily available for use when needed in an ocean survival situation. The third advantage, the present invention is an envelope of an impermeable material to prevent body fluids from escaping into the water and attracting sharks, and it creates a thermal chamber which aids in slowing the onset of hypothermia in cold water conditions, thus increasing survival duration. The fourth advantage of the present invention is that it's made with a reflective silver interior color which serves as a signaling surface designed to improve the user's visibility to rescue craft.

The present invention resolves all the limitations and failings of the prior art by the enduring permanence of the enveloping structure which lasts as long as a person is in an ocean survival situation.

The invention is an improvement over all previous shark attack deterrents because it not only changes the a floating body's profile, but provides visual camouflage, it outlasts colored or scent dyes which dissipate within a few hours, has none of the battery life limitations of electronic devices, or the potential drowning design flaws of the prior art of similar shielding type devices. Additionally, present invention proposed herein exceeds the purpose and scope of all the prior art by providing multiple other functions to aid a person in an ocean survival situation.

BRIEF DESCRIPTION OF THE DRAWINGS

With the above and other related objects in view, the invention consists in the details of construction and combination of parts as will be more fully understood from the following description, when read in conjunction with the accompanying drawings in which.

REFERENCE NUMERALS IN DRAWINGS

Figure 1:
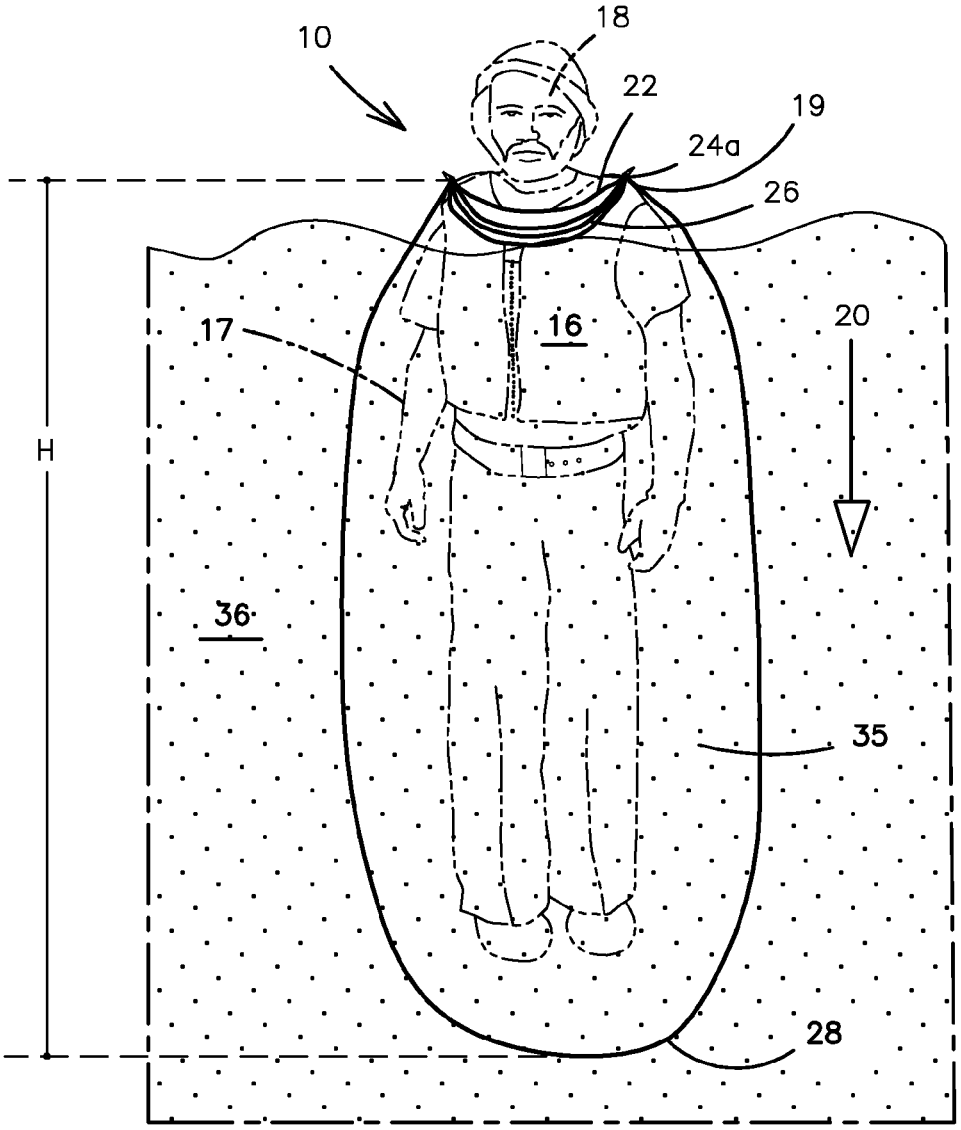
FIG. 1 is a front elevational view of the present invention with a protected user showing excess material 26 extending from amorphous bag 20 at user's shoulders 19.

10 Present Invention
16 life vest or other present invention
17 user (person)
18 user's head
19 user's shoulders
20 vertical of the present invention
22 top open end
24 two fastening means, one on each side
24*a* knots in plastic tails
24*b* hooks
24*c* eyes and pegs
24*d* twist ties
24*e* velcro straps
24*f* cord and knots
26 folds of the flap material to cover the head and upper body
28 bottom edge that is sealed closed
30 silver colored interior
35 exterior of the present invention covered in various camouflaging color patterns
36 ocean or open water
H height

DETAILED DESCRIPTION OF THE EMBODIMENTS OF THE INVENTION

Figure 2:
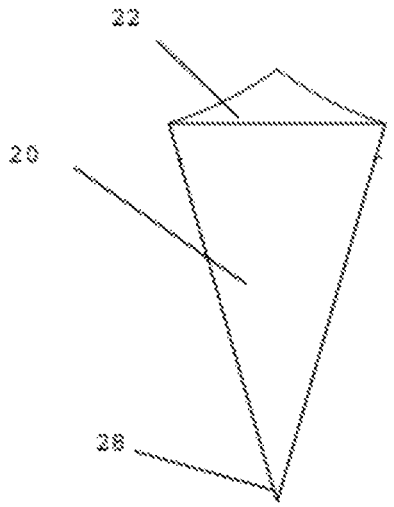
FIG. 2 is an side view of the present invention shown in the previous figure without the person, without excess material 26 or fastening means 24 shown.
Figure 3:
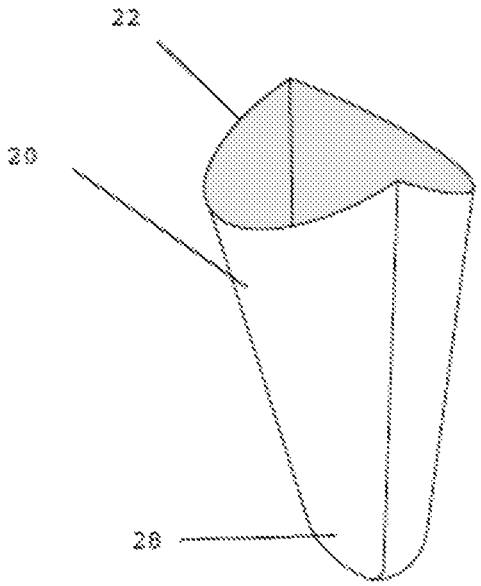
FIG. 3 is an isometric view of the present invention shown in the previous figure without the person, without excess material 26 or fastening means 24 shown.

Referring now to the drawings FIGS. 1-10B where the embodiment of the present invention is generally referred to with numeral 10. As seen in FIG. 1-3, the invention comprises an enclosing, flexible, impermeable, multi-colored, amorphous bag 20 formed and shaped, with a top end open 22, and having at two fastening means 24 mounted to first and second ends of amorphous bag 20 at approximately user's shoulders 19. Fastening means 24 are used to mount life vest 16 to amorphous bag 20. The present invention further includes excess material 26 being excess material of amorphous bag 20. Excess material 26 extends from approximately the location of user's shoulders 19 of amorphous bag 20. Excess material 26 being a part of amorphous bag 20 is thus made of the same material as amorphous bag 20. The present invention further includes bottom sealed end 28.

FIG. 1 is a presentation of the present invention assembly showing it deployed with a floating user 17 inside camouflaged from sharks. FIG. 1 shows amorphous bag 20 with floating user 18 inside, the top open end 22 where the user's head 18 protrudes, two fastening means 24, one on each side of top open end 22 securing it at the shoulders 19 of life vest 16, excess material 26 to cover the user's head and upper body, a bottom edge that is sealed closed 28, the exterior of the present invention covered in various camouflaging color patterns 35.

FIG. 2 is a side elevational view of the embodiment wherein excess material 26 and fastening means 24 are not shown.

Figure 2A:
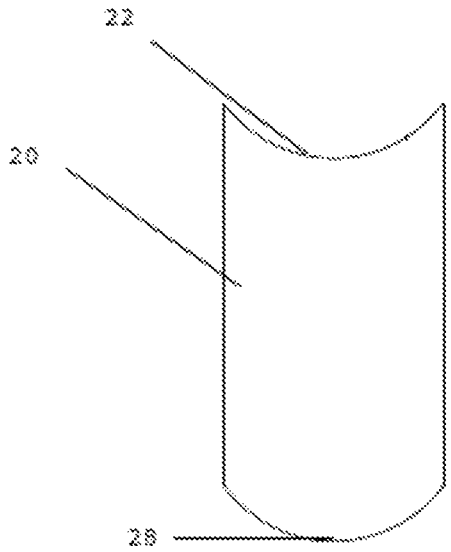
FIG. 2A is the front elevation of the present invention shown in the previous figures, without the person, without excess material 26 or fastening means 24 shown.

FIG. 2A is a front elevational view of the embodiment wherein excess material 26 and fastening means 24 are not shown.

FIG. 3 is an isometric view of the embodiment showing top open end 22 wherein excess material 26 and fastening means 24 are not shown.

Figure 4:
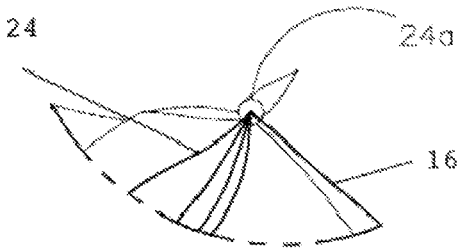
FIG. 4 is a cross section from FIG. 1 of the present invention secured by knots in plastic tails 24*a*.

FIG. 4 is a cross section from FIG. 1 of the embodiment securing life vest 16 to amorphous bag 20 by fastening means of knots in plastic tails 24*a*.

Figure 5:
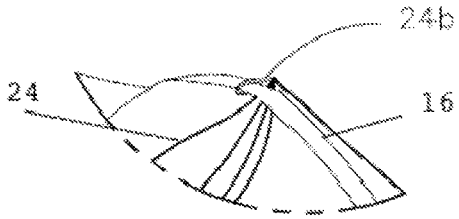
FIG. 5 is a cross section from FIG. 1 of the present invention secured by hooks 24*b*.

FIG. 5 shows a cross section from FIG. 1 of the embodiment securing life vest 16 to amorphous bag 20 by fastening means of hooks 24*b*.

Figure 6:
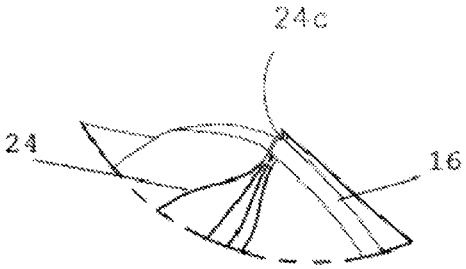
FIG. 6 is a cross section from FIG. 1 of the present invention secured by eyes and pegs 24*c*.

FIG. 6 shows a cross section from FIG. 1 of the present embodiment securing life vest 16 to amorphous bag 20 by fastening means of eyes and pegs 24*c*.

Figure 7:
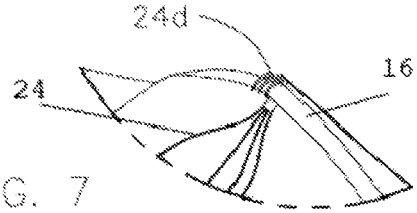
FIG. 7 is a cross section from FIG. 1 of the present invention secured by twist ties 24*d*.

FIG. 7 shows a cross section from FIG. 1 of the embodiment securing life vest 16 to amorphous bag 20 by fastening means of twist ties 24*d*.

Figure 8:
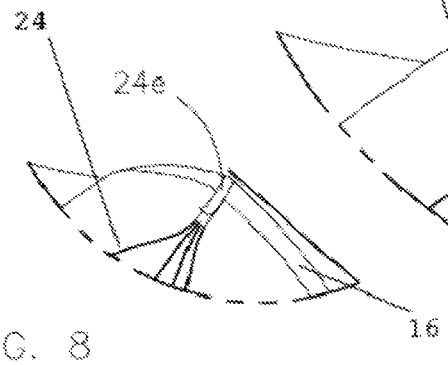
FIG. 8 is a cross section from FIG. 1 of the present invention secured by velcro straps 24*e*.

FIG. 8 shows a cross section from FIG. 1 of the embodiment securing life vest 16 to amorphous bag 20 by fastening means of Velcro straps 24*e*.

Figure 9:
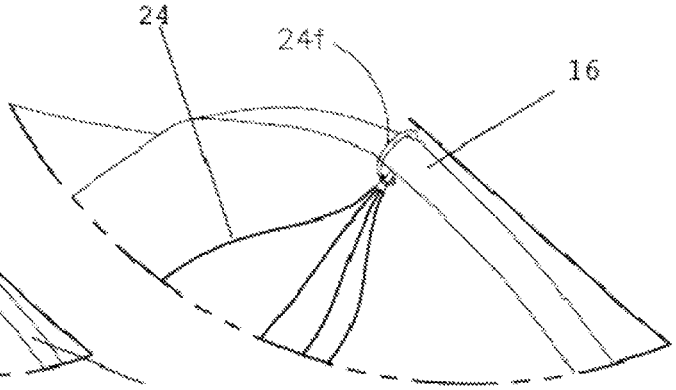
FIG. 9 is cross section from FIG. 1 of the present invention secured by cord and knots 24*f*.
Figure 10A:
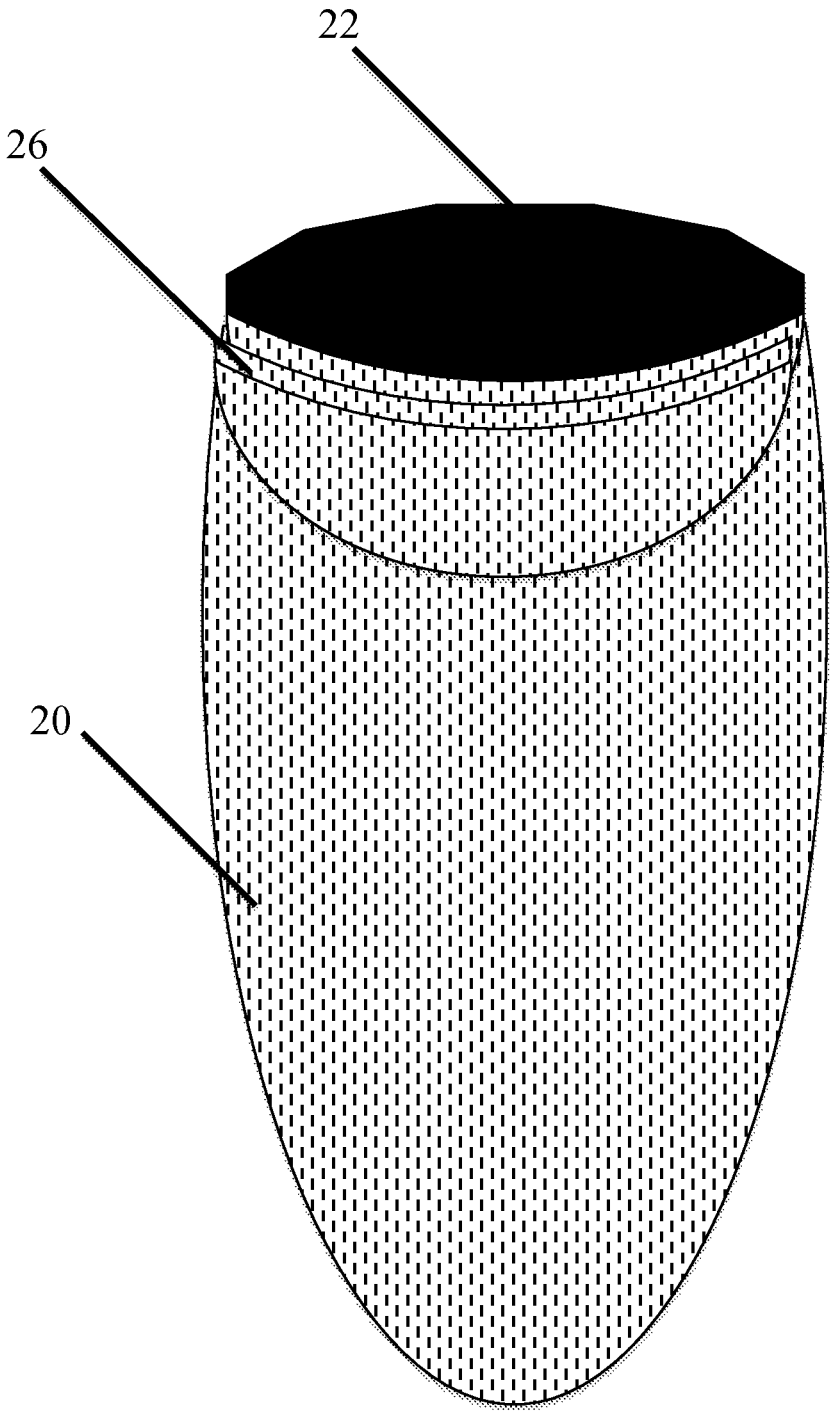
FIG. 10A is a front elevational view of the present invention showing top open end 22 and excess material 26 of amorphous bag 20 extending from approximately where user's shoulders 19 will be.
Figure 10B:
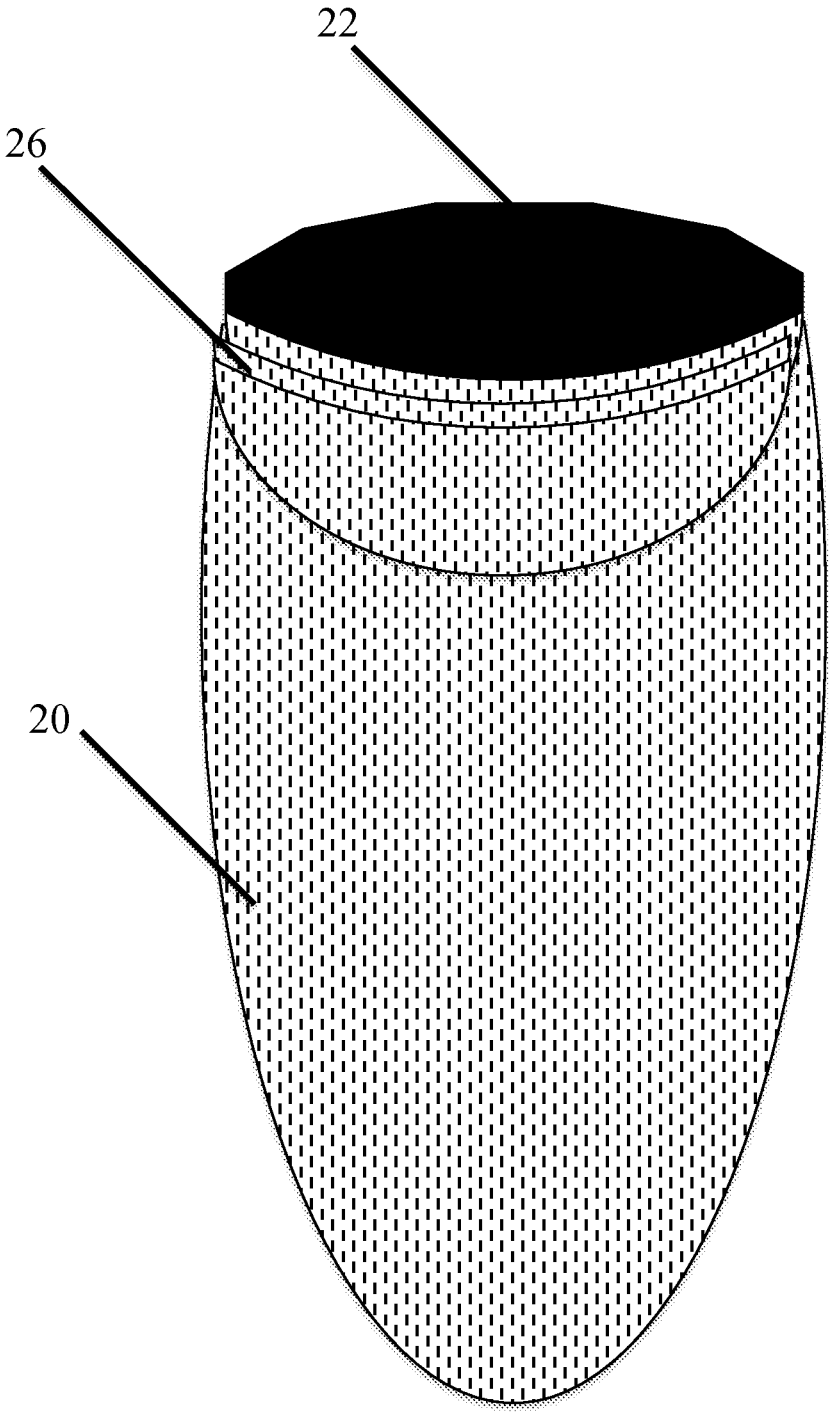
FIG. 10B is a rear elevational view of the present invention showing top open end 22 and excess material 26 of amorphous bag 20 extending from approximately where user's shoulders 19 will be.

FIG. 9 shows a cross section from FIG. 1 of the embodiment securing life vest 16 to amorphous bag 20 by fastening means of cord and knots 24*f*.

The flexible, impermeable, embodiment is fabricated from extrudable materials selected from a group consisting of materials having the properties of boPET polyester, plastic, polyethylene, polystyrene, terephthalate, polycarbonates, acetates, nylons, acetals, butyrates, sulfides, thermoplastic rubbers, two-ply laminated metalized polyester, thermoplastic and/or any material that can be formed into a thin film of a durable thickness, that is cast, extruded or calandarded), into a thin film sheet which lends itself to easy extrusion and shaping; In a embodiment is designed to offer a deterrent to shark attack, the exterior surface is covered in various color patterns designed to camouflage the user, and the interior surface is of a reflective silver color for use a as rescue signal.

Operation:

A person floating at sea in a survival situation faces multiple threats and needs multiple solutions to address those threats. A floating person's profile, their vibrations, and the discharging of blood or other body secretions that attract potential shark attack, they need to survive water conditions, and signal to rescue craft. To address these needs the "Ocean Survival System" subject of the present invention is a multipurpose, compact, improved shark attack deterrent, a thermal envelope, and rescue signal device that should become standard issue and carried by all persons who might possibly find themselves afloat in an ocean or open water survival situation.

To use the present invention, once a person 17 is adrift in the water 36 as represented in FIG. 1, the embodiment 10 is deployed, by unfolding, and filling it with water 36, giving its shape and creating an amorphous blob-like appearance, then slipped up around body 17 to the neck, and secured to life vest 16 using fastening means 24. As seen in FIGS. 4-9, alternate embodiments of fastening means 24 can include: plastic tails 24*a*, hooks 24*b*, eyes and pegs 24*c*, twist ties 24*d*, Velcro straps 24*e*, cords and knots 24*f*, or equivalent means. Life vest 16 is used to provide sufficient buoyancy to keep a person 17 afloat and their head 18 above water 36 while using the present invention. Amorphous bag 20 further includes two flaps of excess material 26 extending from amorphous bag 20 at front and rear sides of top open end 22 as shown on FIGS. 10A and 10B. A user brings both flaps of excess material 26 together over his or her head 18 to cover top open end 22. This is done to fully encase a user thereby hiding his or her silhouette from potential predators or to provide warmth or to provide protection from the sun. The integrally formed continuous sealed envelope with its top edge maintained above the water's surface also prevents body fluids, such as blood from leaking into the water 36.

The embodiment comes with instructions included for how to deploy the embodiment into position, to create the continuous contour, and specifying that to provide most of its functions the embodiment must be used in conjunction with a floatation means presently illustrated as a life vest 16 for buoyancy. In addition to changing the body's profile, when floating at sea, its camouflaging color patterns 35 disguises the embodiment so it blends in with the surrounding ocean to reduce its attraction to potential predators.

When excess material flaps 26 are used to seal amorphous bag 20, any waves that may wash over user 17 while in the embodiment will simply break over user's head 18 reducing a user's susceptibility to drowning when using the embodiment.

It is obvious that many modifications and variations of the present invention in terms of design, shape, size, dimensions, materials, colors, and/or manufacturing of the present invention could be made differently or produced by different manufacturing processes are possible in the light of the above information and, it is therefore understood that within the scope of the disclosed inventive concept, the present invention may be practiced otherwise than as specifically described herein and still not depart from the teaching of this patent.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for deterring shark attacks, and ocean survival consisting of:

a) an amorphous elongated embodiment having interior and exterior surfaces, first and second ends, said first end being open, and said second end closed, said embodiment being made of an impermeable, flexible, multicolored material;

b) at least two fastening members each extending from said first end, opposite to each other and having cooperative dimensions to permit a user to secure said embodiment to a life vest;

c) said amorphous elongated embodiment including two flaps extending from front and rear sides of said first end, opposite to each other and having cooperative dimensions to permit a user to pull said two flaps over his or her head and substantially seal said amorphous bag; and d) said amorphous embodiment having cooperative dimensions to effectively house a user.

2. The system set forth in claim 1, wherein said multicolored material is colored to look like sargasso seaweed or an underwater rays of sunlight.

3. The system set forth in claim 2, the interior surface includes a reflective silver color material which the user may use to reflect the sun light to signal rescuers.

* * * * *